United States Patent [19]

Patton et al.

[11] 4,204,426

[45] May 27, 1980

[54] MEASURING CASING COUPLER APPARATUS

[75] Inventors: Franklin D. Patton, West Vancouver; James D. McFarlane, Vancouver, both of Canada

[73] Assignee: Westbay Instruments Ltd., West Vancouver, Canada

[21] Appl. No.: 959,842

[22] Filed: Nov. 13, 1978

[51] Int. Cl.[2] ..... E21B 49/00

[52] U.S. Cl. ..... 73/151

[58] Field of Search ..... 73/155, 151, 422 R, 73/152; 166/69, 166, 169, 264; 33/304; 138/104

[56] References Cited

U.S. PATENT DOCUMENTS

| | | | |
|---|---|---|---|
| 2,651,199 | 9/1953 | Collins et al. | 33/304 X |
| 3,422,896 | 1/1969 | Nutter | 73/155 X |
| 4,120,520 | 10/1978 | Ahlstone | 285/305 X |

*Primary Examiner*—Jerry W. Myracle

*Attorney, Agent, or Firm*—Fulwider, Patton, Rieber, Lee & Utecht

[57] ABSTRACT

A coupler interconnecting casings through which can move instruments for taking measurements and samples for geological, geophysical and other purposes. The coupler is a tube having opposite ends registering with and connected to measuring casings. A sealing connecting element is provided between the tube ends and the adjacent casing ends. A measuring port in the tube wall is normally closed by a valve which is operable from within the tube to open the port. A stop arrangement in the tube is so positioned relative to the measuring port as to stop an instrument in the tube in correct operating position at the port for taking measurements or samples through the port. In a broader sense, the measuring port and valve can be omitted, in which case the stop arrangement stops the instrument at a desired position for measuring or other purposes.

14 Claims, 11 Drawing Figures

4
42
20
37
54
49
50
45
46
38
106
35
18
105
107
109
71
73
76
81
70
61
58
62
78
64
67
60
77
73
74
39
40
83
84
79
38
37
45
49
4

42
20
54
49
50
37
45
46
38
106
35
105
105
18
39
71
73
76
81
78
77
73
74
70
40
45
38
37
52
49

20a
54
49
50
45
46
56
37
18a

MEASURING CASING COUPLER APPARATUS

FIELD OF THE INVENTION

This invention relates to measuring casing apparatus including couplers for interconnecting axially aligned measuring casings and arranged to permit geological and geophysical measurements and/or samples to be taken at one or more different levels.

DESCRIPTION OF THE PRIOR ART

It is common for internally grooved casings to be placed in wells or drill holes to permit an inclinometer to be inserted inside the casing to measure the inclination of the casing at various depths and at different times. Movement of the surrounding soil or rock can be inferred by noting changes in the inclination of the casing between successive readings. However, the existing inclinometer casings are not suitable for making numerous piezometric measurements to establish and monitor the distribution of fluid or gas pressure on the exterior walls of the casing. Occasionally, the bottoms of existing types of inclinometer casing can be left open so that they can be used to measure fluid or gas pressures and to take samples at a single point. However, even in this case it is difficult to ensure that a positive hydraulic seal has been made on the exterior of the casing to ensure the necessary hydraulic isolation of the measuring point. Furthermore, prior to this invention, the casings for inclinometers had to be internally grooved.

It is also common for one or two piezometric (fluid or gas pressure) measurements to be made in a single well and occasionally as many as four different locations are monitored in a single well. However, in these cases separate casings or individual hydraulic or pneumatic tubing are required to reach each piezometer location and there is a practical limit of about three or four installations that can be successfully placed in a single well. Another current method of making several piezometer measurements in a single well is to install electrical or electronic devices in the well. However, there is a practical limit to the number of such devices that can be successfully installed and sealed in a well and these devices are every susceptible to errors during longterm monitoring programs as moisture seals tend to leak disturbing the electric or electronic circuitry. These devices are also susceptible to damage from lightning discharges. Existing pneumatic and electrical or electronic devices cannot easily be checked or recalibrated following installation. Thus, the quality of their data cannot be verified.

When currently available pneumatic, electrical and electronic piezometers are sealed in a well, fluid or gas samples cannot be taken. Therefore, another well must be drilled for fluid or gas sampling. Fluid or gas samples are often taken in wells for analysis of the quality or chemical composition. However, methods of sampling do not permit a high density of sampling points down a well.

In lakes and rivers, water sampling points should be reoccupied as closely as possible as to depth and location for repetitive tests for samples to be clearly comparable. Also, the sampling tool should have a negligible effect on the existing hydrologic environment during the sampling process.

Although the couplers of this invention and the casings associated with them are primarily designed for taking geological and geophysical measurements and samples, they can be used for other purposes, such as to take measurements and samples from a surrounding environment in which they are located. For the sake of convenience, this equipment will be described relative to the geology and geophysical field.

SUMMARY OF THE INVENTION

The present invention serves to overcome the above-mentioned problems by providing measuring casing apparatus including a special coupler, a plurality of which can be used to interconnect measuring and/or sampling casings as they are inserted in wells or drill holes. One of these couplers is provided in the casing assembly at each level where measurements are to be made and/or samples are to be taken. If desired, each coupler has a measuring port normally closed by a valve which can be opened from within the coupler. Instruments such as inclinometers can be moved up and down along the passageway formed by the aligned and interconnected casings and couplers to take measurements at different levels, and this can be done without opening the coupler valves if they are present. The preferred form of this invention eliminates the necessity for internal grooves in the casings for inclinometers thereby allowing the use of normal or plain casings.

Instruments such as measuring and/or sample-taking probes also can be moved up and down through the casing passageway. Internal grooves are not required in the casings when the preferred coupler is used. Probes of this type are designed to take measurements at the couplers, such as pressure, temperature, chemical qualitites and the like measurements, and/or to take samples, such as samples of gases from outside the casing and couplers, or samples of the surrounding material. Each of the instruments or probes is provided with a stop arm radiating therefrom. The arm can radiate from its instrument at all times, but it is preferable that it can be retracted and extended when desired, and can be depressed from the extended position. The operation of the various elements of the instrument or probe is controlled from above the ground, and the control signals may be pneumatic, hydraulic and/or electrical. The actual construction and control of these probes constitute a separate invention which is the subject matter of one or more additional applications.

Each coupler of the present invention includes stop means therein so positioned relative to its measuring port as to stop a probe therein in correct operating position at the port for taking measurements and/or samples through the port. The port is opened when desired by the probe.

An important advantage of the preferred form of coupler of this invention is that all of the depth location and alignment mechanisms are located within this coupler thereby allowing normal or plain casings to be used for the installation.

In a broad sense, the coupler may not have a measuring port, in which case the instrument is stopped at a desired level to take a suitable measurement, such as a temperature or a radio activity measurement.

A coupler according to the present invention comprises a coupler tube having opposite ends registering with and connected to ends of axially aligned measuring casings, at which time the interior of said tube forms a common passageway with the interiors of the casings, and stop means in the tube so positioned as to stop an instrument in said tube in a desired position for taking measurements and/or samples.

In a further development, a measuring port is located in the wall of the coupler tube spaced from the ends thereof and permitting communication between the interior and exterior of the tube, and a valve normally closes this port and is operable from within the tube to open the port.

BRIEF DESCRIPTION OF THE DRAWINGS

Casing apparatus of this invention is illustrated by way of example in the accompanying drawings, in which.

DESCRIPTION OF THE PREFERRED EMBODIMENTS

Figure 1:
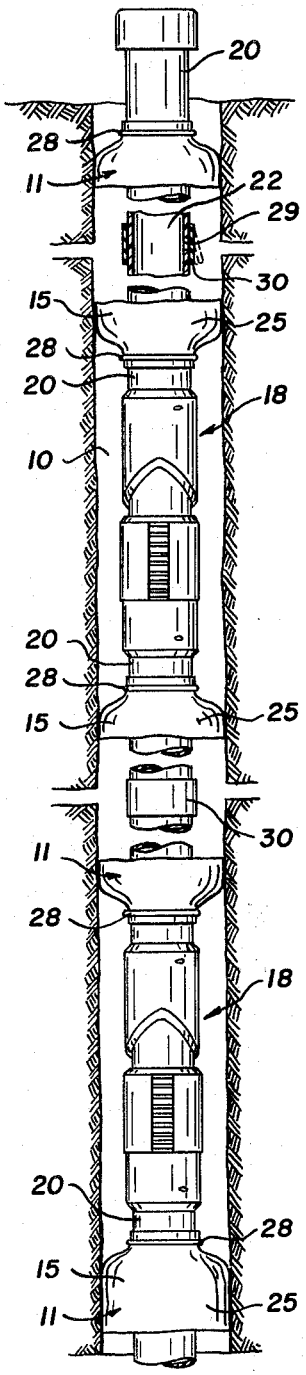
FIG. 1 diagrammatically illustrates couplers of this invention interconnecting adjacent ends of geological and geophysical measuring casings.

Referring to FIG. 1 of the drawings, 10 is a well or bore hole, and 11 is a geology and geophysical casing assembly made up of a plurality of packers 15 interconnected by couplers 18 in accordance with the present invention. The packers 15 include elongate casings 20 which are interconnected at adjacent ends by said couplers to form a passageway 22 extending longitudinally through the casing assembly.

In this example, the casing 20 of each packer 15 extends through and is substantially concentric with an expandable cylindrical packer tube, membrane or bag 25 formed of suitable elastic or stretchable material, such as natural or synthetic rubber or a plastic such as urethane. Urethane is preferable for this purpose because it is readily moldable, and has high strength and abrasion characteristics when expanded. The membrane is clamped at opposite ends to casing 20 by circular fasteners or clamps 28. The ends of casing 20 project beyond the ends of the packer tube 25.

A part 29 in casing 20 within tube or bag 25 may under some circumstances be left open, but normally is closed by a check valve 30. In this example, valve 30 is in the form of a wide elastic band extending around the casing and over port 29. After the casing assembly 11 been inserted in well 10 the packer tubes or bags 25 of packers 15 are inflated or expanded by directing a fluid, such as air or water, into the respective bags through the valve-controlled ports thereof. The valves 30 will open under internal pressure to permit fluid to flow into the packer tubes and close when the internal pressure is released and when they are subjected to external pressure. If desired, bags 25 may contain a material, such as cement or grout, which hardens or sets when water or other suitable liquid is directed into the bags.

A preferred form of coupler 18 in accordance with this invention is illustrated in FIGS. 2 to 6. This coupler is in the form of a tube 35 formed of plastic, metal or the like. The ends 37 of the tube are open and have annular enlargements 38 therein and opening outwardly therefrom for receiving the ends of casings 20. If desired, this arrangement can be reversed, that is, the ends of the coupler tube may be of such size as to fit into the ends of the casings, as shown in FIG. 3A. The interior or bore 39 of the central section 40 of tube 35 is axially aligned with and of the same diameter as the interior or bore 42 of the casings 20.

Figure 3:
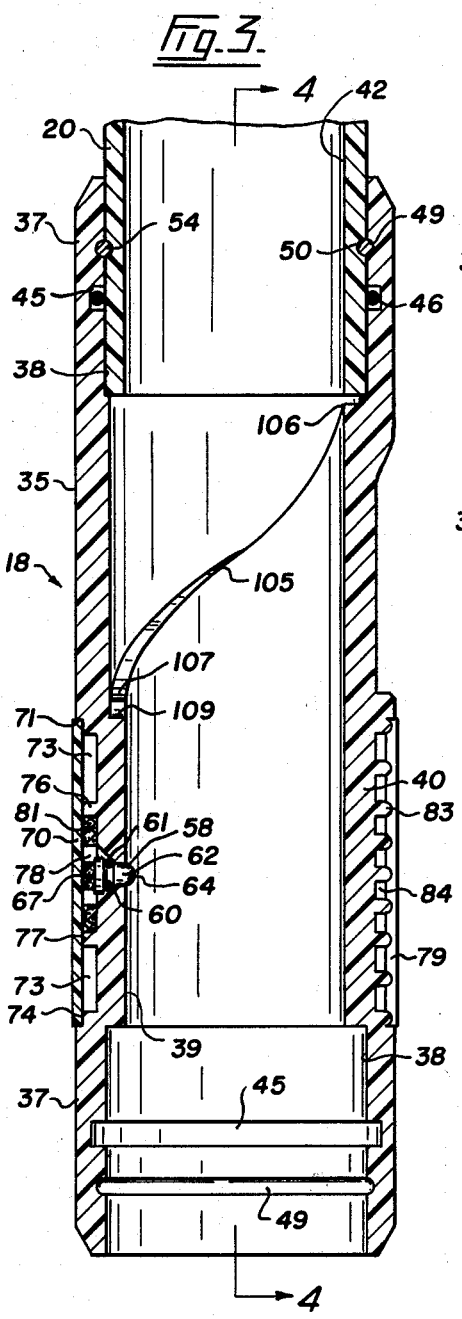
FIG. 3 is a longitudinal section taken on the line 3—3 of FIG. 2.
Figure 4:
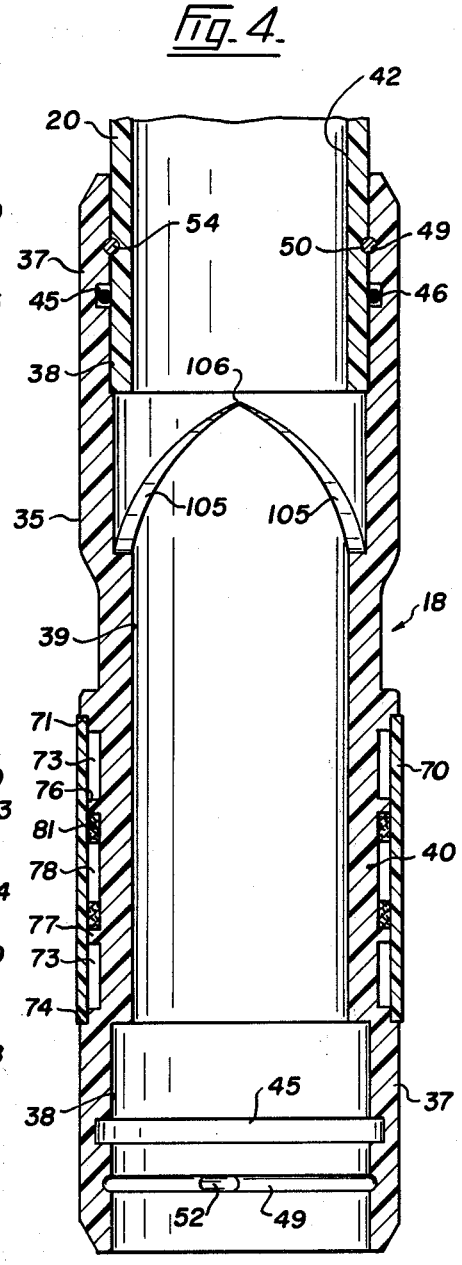
FIG. 4 is a longitudinal section through the coupler taken at right angles to the section of FIG. 3.

Suitable connecting and sealing means is provided between each end of the coupler tube and the adjacent end of a casing. In FIGS. 3 and 4, sealing connecting means is provided in the enlargement 38 of each end 37 of the coupler tube. This sealing connecting means includes an annular groove 45 in the inner surface of the coupler tube and containing a sealing ring 46 therein. This ring receives and fits tightly around the end of casing 20 within enlargement 38. The groove 45 is spaced inwardly from the adjacent end of the tube 35. Another annular groove 49 is formed in the inner surface of coupler tube 35 between groove 45 and the adjacent tube end, groove 49 overlying and registering with a similar annular groove 50 formed in the outer surface of the end of casing 20. An orifice 52 extends through the wall of tube 35 and opens into the groove 49 thereof, see FIGS. 2 and 6. A flexible shear fastener 54 extends through the registering annular grooves 49 and 50 to lock coupler 18 and casing 20 together. This fastener is insertable into the registering grooves through orifice 52, and can be removed through said orifice. The fastener may be in the form of a flexible wire, strand or cord which is strong enough to prevent relative longitudinal movement between the coupler tube and the casing. As an alternative, the connecting and sealing means may be achieved by normal male and female pipe threads and gaskets between each end of the coupler tube and the adjacent casing.

FIG. 3A illustrates alternative sealing connecting means between a coupler 18*a* and a casing 20*a*. This coupler has a reduced end 53 which fits into the adjacent end of casing 20*a* which is shaped for this purpose. The groove 45 is located in the outer surface of coupler reduced end 53 and sealing ring 46 is located therein. Registering grooves 49 and 50 are formed in the adjacent surfaces of the coupler and the casing, respectively, and contain shear fastener 54. The fastener is insertable in and removable through an orifice 56 in casing 20*a* and communicating with the grooves 49, 50.

Figure 5:
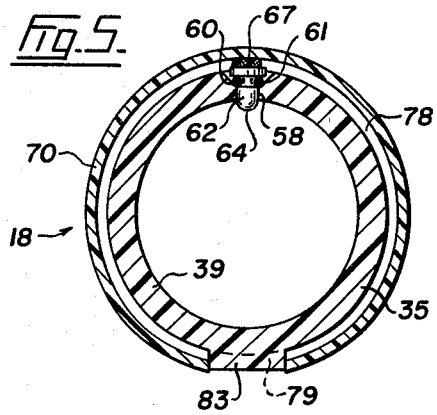
FIG. 5 is a cross section taken on the line 5—5 of FIG. 2.
Figure 6:
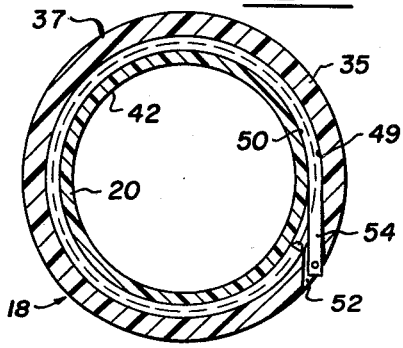
FIG. 6 is a cross section taken on the line 6—6 of FIG. 2.

Preferably a measuring port 58 is formed in the wall of coupler tube 35 spaced from the ends of said tube. This port is normally closed by a suitable valve which can be opened from within the tube. An example of a valve suitable for this purpose is shown in FIGS. 3 and 5.

A valve 60 having a seal in the form of an O-ring 61 is seated in port 58 and has a stem 62 extending through the port and slightly into the bore 39 of tube 35. This stem preferably has a rounded end 64. Suitable means is provided for normally retaining valve 60 in the closed position, and in this example, an elastic pad 67 presses against the valve to retain the latter seated in and closing port 58. This pad is retained in position in any desired manner, and one way of doing this will be explained in the following description.

Port 58 is provided to enable measurements, such as pressure and temperature measurements, to be taken in the area surrounding coupler 18 within bore hole 10 and between packers 15. Samples of gases or liquids in the bore hole and/or of the material in which the bore hole is formed can also be taken in through port 58.

As it is desirable in most cases to protect the port and valve as much as possible from particles of dirt, a shield in the form of wide band 70 can extend around the outer surface of coupler tube 35 and preferably fits in a wide annular groove 71 formed in the outer surface of the tube and overlying but spaced from valve 60. By referring to FIG. 3 it will be seen that the groove 71 overlies another annular groove 73 which is formed in and extends around the outer surface of the coupler tube, said groove 73 being narrower than groove 71 so as to form annular shoulders 74 on which band 70 seats. A pair of spaced ribs 76 and 77 project upwardly from the bottom of groove 73 and form a groove or passage 78 therebetween. It will be noted that valve 60 and elastic pad 67 are located within passage 78 of groove 73 beneath cover band 70 and that said cover band retains the pad in position on the valve. The ribs 76 and 77 support cover band 70 against external pressure and keep it clear of valve 60.

Figure 2:
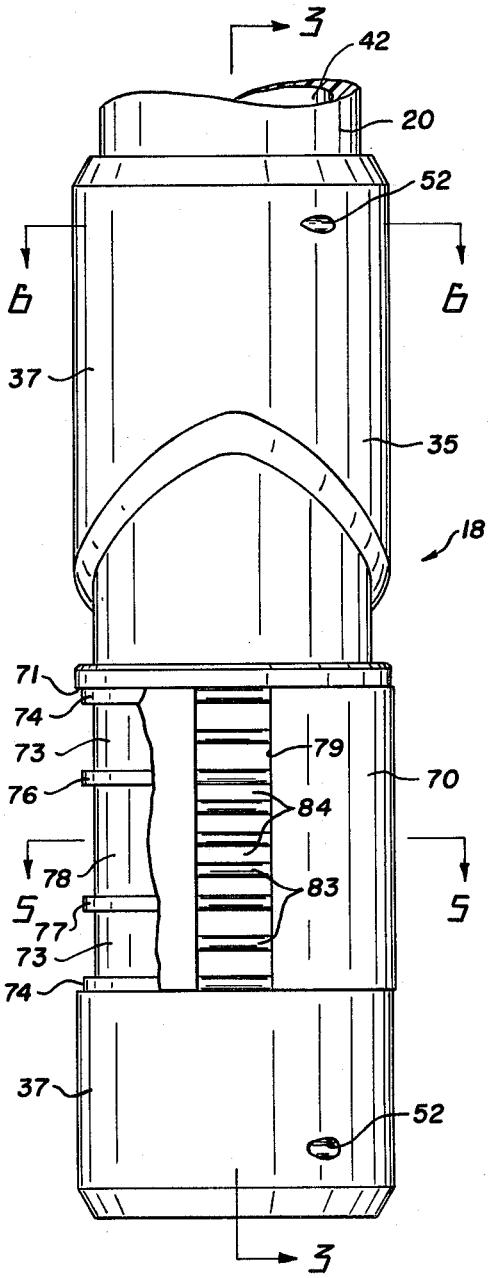
FIG. 2 is an enlarged side elevation of a coupler embodying a preferred form of this invention.
Figure 3A:
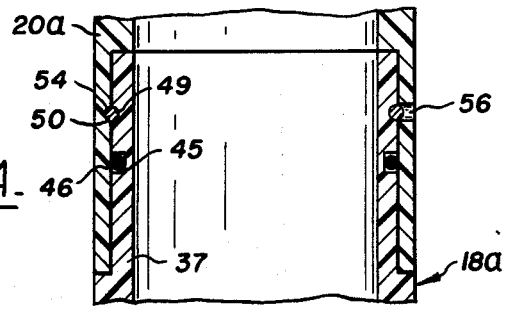
FIG. 3A is a fragmentary sectional view illustrating an alternative form of sealing connecting means between a coupler and a casing.

Cover band 70 is formed with a relatively large opening 79 therein, see FIGS. 2 and 5, this opening preferably being spaced away from port 58, and in this example is on the opposite side of tube 35 from the port. The passage 78 between ribs 76 and 77 extends in opposite directions from band opening 79 to port 58. If desired, this passage can be filled with a suitable filter material 81 which prevents particles from travelling to the port and its valve. In addition, short annular ribs 83 may be formed on and project outwardly from the bottom of space or passageway 78 within the cover band opening 79. These ribs have spaces 84 therebetween, some of which are located in passage 78. The spaces 84 located in passage 78 are in communication at opposite ends thereof with the passage. These ribs 83 help prevent the opening 79 from being clogged with dirt.

Figure 7:
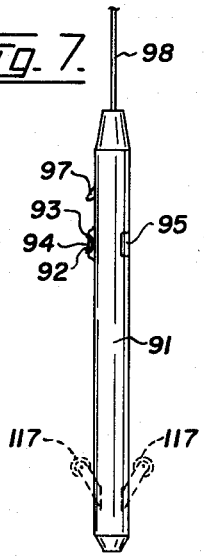
FIG. 7 is a diagrammatic elevation of an instrument or probe for taking measurements and/or samples.
Figure 8:
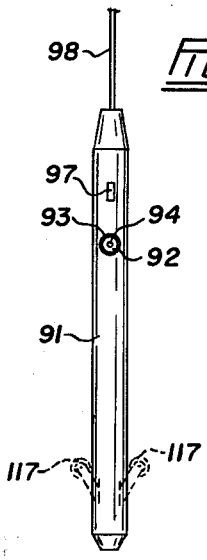
FIG. 8 is a diagrammatic elevation of the probe taken at right angles to FIG. 7.

FIGS. 7 and 8 illustrate an example of an instrument in the form of a probe 90 that can be used with the casing assembly 11. This probe is in the form of an elongate cylindrical casing 91 having a raised and ported face plate or surface 92 facing laterally therefrom, said face plate having a circular and resilient ring seal 93 thereon and projecting therefrom. A port 94 is located in face plate 92 within ring seal 93 and communicates with the interior of the probe. On the opposite side of the probe casing is an operating plate or shoe 95 which is normally retracted but which can moved a little outwardly in the radial direction. The probe casing also has an outwardly and downwardly extending stop arm 97 radiating therefrom. Although this arm may be fixed, it is preferably retractable into the casing. In addition, the stop arm preferably is depressible when the probe is being moved upwardly, but not when the probe moves downwardly. A cable 98 is connected to the upper end of probe 90 by means of which the latter can be lowered through the passageway 22 in casing assembly 11 and drawn upwardly therethrough. This probe contains whatever mechanisms are necessary to make geophysical measurements, such as to measure temperatures, pressures and the like and to take samples of gas, liquid or particulate material. It also includes the necessary mechanism and controls for extending and retracting operating plate 95 and stop arm 97. The hydraulic, pneumatic or electrical connections for the probe are within or extend along the side of cable 98. As this probe does not form a part of the present invention, it is not necessary to describe herein the various mechanisms thereof.

Suitable stop means is provided on coupler tube 35 so positioned relative to measuring port 58 as to stop probe 90 in the tube in correct operating position at the measuring port for taking measurements and samples through said port. In coupler 18, this stop means comprises a pair of helical shoulders 105 on the inner surface of the wall of tube 35 and curving away from each other from adjacent outer ends 106 inwardly of the tube and back to adjacent inner ends 107 on the opposite side of the tube from said outer ends. A stop surface 109 is formed on the inner surface of the coupler tube at the inner ends 107 of the helical shoulders 105.

When probe 90 moves downwardly through the passageway 22 into tube 35 of probe 18, the projecting stop arm 97 of the probe engages a portion of one of the shoulders 105. As the probe continues to move downwardly, the stop arm rides on the shoulder with which it is in engagement and is rotated and guided on to the stop surface 109. The helical surfaces and the stop surface are so located that when the stop arm of the probe is located on the stop surface, the probe is in correct operating position both longitudinally and circumferentially at measuring port 58. With the illustrated probe 90, the face plate 92 thereof with the port 94 therein is opposite port 58 at this time, and the seal ring 93 surrounds said measuring port. When operating plate 95 is moved outwardly, it engages the wall of coupler tube 35 at a point opposite the measuring port, and this shifts the probe 90 laterally until seal 93 engages the inner wall of the tube around the measuring port to isolate the latter from the rest of the interior of the coupler tube. At the same time, face plate 92 presses against stem 62 to lift valve 60 off its seat. The probe can now be operated to take the desired measurements or samples.

If the meausuring port and its valve are omitted, the stop 109 surface stops the instrument at a desired level in the casing assembly. This stop surface may also stop an instrument in a correct position relative to the packer port 29 for inflating or other purposes.

Although two shoulders 105 have been shown, only one of these shoulder may be used, but in this case, the shoulder would have to extend in a helical substantially all the way around the interior surface of the coupler tube. In addition, stop surface 109 would have to be in the form of a depression so that probe stop arm 97 would be retained on the stop surface aftering being lead thereto by the helical shoulder.

Figure 9:
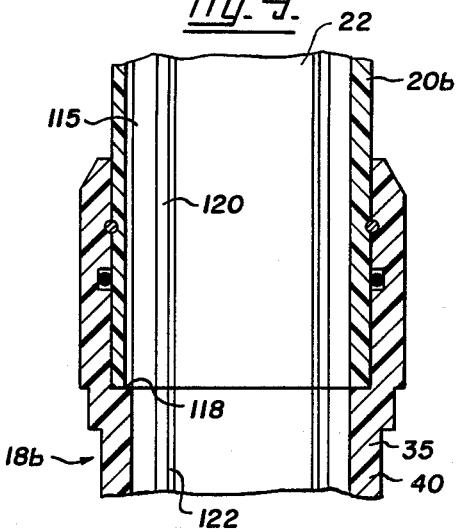
FIG. 9 is a longitudinal and fragmentary section through a coupler embodying an alternative form of the invention and the end of an associated casing.

FIG. 9 illustrates an alternative coupler **18*b* incorporating another embodiment of this invention. This coupler is used with a geological casing 20*b* that has an axial groove 115 extending longitudinally thereof and opening out from its ends. This groove is aligned with a stop surface 118 formed in coupler 18*b*. The stop arm 97 of the instrument or probe 90 rides in groove 115 as the instrument moves downwardly through passageway 22, and when said stop arm engages the stop surface 118, the instrument is stopped. The groove 115 and the stop surface are so located relative to the measuring port 58 that the instrument stops in the correct position for taking measurements and/or samples. If desired, a plurality of spaced axial grooves 120 may be formed in the inner surface of casing 20*b* and in which rollers 117 on probe 90 ride, said rollers being shown in broken lines in FIGS. 7 and 8. These rollers are retractable in the standard manner. The rollers ride grooves 120 to prevent the probe from rotating circumferentially in passageway 22. If desired, the tube 35 of coupler 18*b* may be provided in its central section 40 with axial grooves 122 in the same in number as the casing grooves 120 and in alignment therewith. When it is desired to have the probe pass through coupler 18*b*, its stop arm 97** is retracted.

Figure 10:
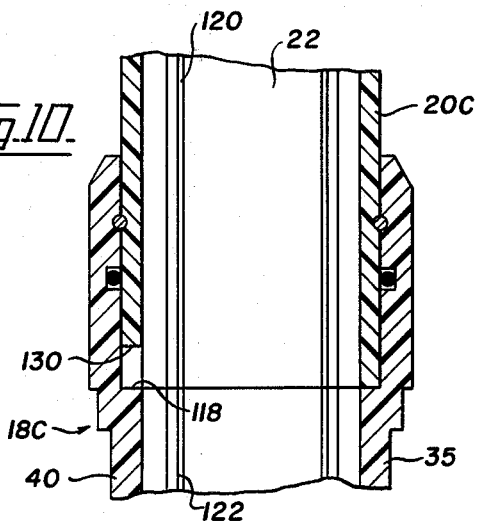
FIG. 10 is a view similar to FIG. 9 of a coupler embodying still another form of the invention.

FIG. 10 illustrates a coupler **18*c* embodying another alternative form of the invention. This coupler is used in association with a casing 20*c* that has, instead of the axial groove 115, a notch 130 in the end thereof and opening out from said end, said notch being over stop surface 118 of the coupler. Casing 20*c* has axial grooves 120 therein and the coupler 18*c* may have grooves 122** therein aligned therewith.

With this arrangement, when the stop arm 97 of probe 90 enters notch 130 it is directed onto coupler stop surface 118, so that the probe is stopped in the correct operating position for taking measurements and/or samples through the measuring port of the coupler.

In order to take a measurement or sample at a desired level in bore hole 10, the probe 90 is lowered with its stop arm 97 retracted until the probe is just below the coupler located at the desired level. Then the probe is raised with the stop arm extended until the probe is a little above said coupler, and when the probe is lowered again, the stop arm is directed on to the stop surface 109 or 118 to stop the probe in the correct operating position to take a measurement and/or sample at the desired level. As the probe is raised during this maneuver, the stop arm is depressed when it contacts valve stem 62 so as not to open the valve 60 at this time.

Although this invention is described in connection with taking measurements and/or samples in a well or bore hole, it is to be understood that the invention may be employed where it is desired to take measurements and/or samples at different levels of the surrounding environment. For example, it may be used for taking samples at different levels in a body of water, or for taking temperature or other measurements at different levels in other situations.

We claim:

1. Measuring casing apparatus through which can be moved instruments for taking measurements and/or samples from the surrounding environment at one or more predetermined levels, said instruments having laterally extending depressible stop arms, said apparatus comprising a plurality of axially aligned measuring casings, at least one coupler tube having opposite open ends registering with and connected to ends of adjacent measuring casings, said coupler tube being located at a predetermined level when said casing apparatus is in operation, the interior of the coupler tube forming a common passageway with the interiors of said casings through which instruments can be moved to take measurements or samples, and stop means on the coupler tube at a side of said passageway and so positioned as to be engaged by an extended stop arm of an instrument moving through the passageway to stop said instrument in a desired position for taking measurements and/or samples, said stop means allowing unimpeded movement of the instrument through the passageway when the stop arm of the instrument is depressed.

2. Casing apparatus as claimed in claim 1 comprising a measurement port in the coupler tube spaced from the ends thereof and permitting communication between the interior of the tube and the exterior thereof, said stop means being so positioned as to stop a measuring instrument in the tube in correct operating position at the measurement port for taking the measurements and samples through said port.

3. A casing apparatus as claimed in claim 2 comprising a valve normally closing the measurement port and operable from within the coupler tube to open said port.

4. Casing apparatus as claimed in claim 1 in which said ends of the tube are large enough to receive the ends of said measuring casings therein, and comprising sealing connecting means at each end of the coupler tube, each sealing connecting means comprising:

a first annular groove in the inner surface of the coupler tube spaced inwardly from an adjacent end of the tube, an annular sealing ring in the first groove to receive and fit tightly around the casing end fitting in the tube, a second annular groove in the inner surface of the tube between the first annular groove and the adjacent tube end, said second groove overlying and registering with a third annular groove in said casing end, an orifice through the tube wall and opening into the second annular groove, and a flexible shear fastener fitting in said registering second and third annular grooves, said fasteners being insertable into and removable from the registering grooves through said orifice.

5. Casing apparatus as claimed in claim 1 in which said ends of the tube are large enough to receive the ends of said measuring casings therein, and comprising sealing connecting means at each end of the coupler tube, each sealing connecting means comprising:

a first annular groove in the outer surface of the casing fitting in a coupler tube end, an annular sealing ring in the first groove bearing against the adjacent surface of the tube, a second annular groove in the inner surface of the tube between the first annular groove and the adjacent tube end, said second groove overlying and registering with a third annular groove in said casing end, an orifice through the tube wall and opening into the second annular groove, and a flexible shear fastener fitting in said registering second and third annular grooves, said fastener being insertable into and removable from the registering grooves through said orifice.

6. Casing apparatus as claimed in claim 1 comprising an axial groove on the inner surface of at least one of said casings, and in which said stop means comprises a stop surface on the inner surface of the wall of the coupler tube and aligned with said casing groove, said stop surface being engageable by a stop arm radiating from a measuring instrument to stop movement of the instrument in the tube, said stop surface being so positioned that the instrument is located in the desired position both longitudinally and circumferentially.

7. Casing apparatus as claimed in claim 6 in which said ends of the tube are large enough to receive the ends of the measuring casings, therein, and comprising sealing connecting means at each end of the coupler tube, each sealing connecting means comprising a first annular groove in the inner surface of the coupler tube spaced inwardly from an adjacent end of the tube, an annular sealing ring in the first groove to receive and fit tightly around the casing end fitting in the tube, a second annular groove in the inner surface of the tube between the first annular groove and the adjacent tube end, said second groove overlying and registering with a third annular groove in said casing end, an orifice through the tube wall and opening the second annular groove, and a flexible shear fastener fitting in said registering second and third annular grooves, said fastener being insertable into and removable from the registering grooves through said orifice.

8. Casing apparatus as claimed in claim 6 in which said ends of the tube are large enough to receive the ends of the measuring casings therein, and comprising sealing connecting means at each end of the coupler tube, each sealing connecting means comprising a first annular groove in the inner surface of the coupler tube spaced inwardly from an adjacent end of the tube, an annular sealing ring in the first groove to receive and fit tightly around the casing end fitting in the tube, a second annular groove in the inner surface of the tube between the first annular groove and the adjacent tube end, said second groove overlying and registering with a third annular groove in said casing end, an orifice through the tube wall and opening into the second annular groove, and a flexible shear fastener fitting in said registering second and third annular grooves, said fastener being insertable into and removable from the registering grooves through said orifice.

9. Casing apparatus as claimed in claim 1 comprising a notch in the wall of at least one of said casings and opening out from the end thereof positioned to receive stop arms radiating from the instruments, and in which said stop means comprises a stop surface on the inner surface of the wall of the coupler tube at and aligned with said casing notch, said stop surface being engageable by a stop arm in the notch to stop movement of a measuring instrument in the tube, said stop surface being so positioned that the instrument is located in the desired position both longitudinally and circumferentially.

10. Measuring casing apparatus through which can be moved instruments for taking measurements and/or samples from the surrounding environment said apparatus comprising a coupler tube having opposite open ends for registering with and connection to axially aligned measuring casings, at which time the interior of said tube forms a common passageway with the interiors of the casings through which instruments can be moved to take measurements or samples, stop means on the coupler tube so positioned as to stop an instrument in a desired position for taking measurements and/or samples, said stop means comprising a helical shoulder on the inner surface of the wall of the coupler tube, said shoulder curving around the longitudinal axis of the tube and said passageway and extending from an outer end away from an end of the tube to an inner end remote from said tube end, and a stop surface on said inner surface at the inner end of the helical shoulder, said helical shoulder being engageable by a stop arm radiating from the instrument as the latter moves along the passageway into the tube to guide the arm on to the stop surface to stop movement of the instrument, said helical shoulder and said stop surface being so positioned relative to the measurement port that the instrument is located in the desired position both longitudinally and circumferentially.

11. Measuring casing apparatus through which can be moved instruments for taking measurements and/or samples from the surrounding environment, said apparatus comprising a coupler tube having opposite open ends for registering with and connection to axially aligned measuring casings, at which time the interior of said tube forms a common passageway with the interiors of the casings through which instruments can be moved to take measurements or samples, stop means on the coupler tube so positioned as to stop an instrument in the desired position for taking measurements and/or samples, said stop means comprising a pair of helical shoulders on the inner surface of the wall of the coupler tube, said shoulders curving away from each other from adjacent outer ends inwardly of the tube and back to adjacent inner ends on the opposite side of the tube from said outer ends, and a stop surface at the inner ends of the helical shoulders, either of said helical shoulders being engageable by a stop arm radiating from the instrument as the latter moves along the passageway into the tube to guide the arm on to the stop surface to stop the movement of the instrument, said helical shoulders and said stop surface being so positioned relative to the measuring port that the instrument is located in the correct position both longitudinally and circumferentially.

12. Casing apparatus as claimed in claim 11 in which said ends of the tube are large enough to receive the ends of the measuring casings therein, and comprising sealing connecting means at each end of the coupler tube, each sealing connecting means comprising a first annular groove in the inner surface of the coupler tube spaced inwardly from an adjacent end of the tube, an annular sealing ring in the first groove to receive and fit tightly around the casin end fitting in the tube, a second annular groove in the inner surface of the tube between the first annular groove and the adjacent tube end, said second groove overlying and registering with a third annular groove in said casing end, an orifice through the tube wall and opening into the second annular groove, and a flexible shear fastener fitting in said registering second and third annular grooves, said fastener being insertable into and removable from the registering grooves through said orifice.

13. Casing apparatus as claimed in claim 10 or 11 comprising a measurement port in the coupler tube spaced from the ends thereof and permitting communication between the interior of the tube and the exterior thereof, said stop means being so positioned as to stop a measuring instrument in the tube in correct operating position at the measurement port for taking the measurements and samples through said port.

14. Casing apparatus as claimed in claim 10 or 11 comprising a measurement port in the coupler tube spaced from the ends thereof and permitting communication between the interior of the tube and the exterior thereof, said stop means being so positioned as to stop a measuring instrument in the tube in correct operating position at the measurement port for taking the measurements and samples through said port, and a valve normally closing the measurement port and operable from within the coupler tube to open said port.

* * * * *